US007018220B2

(12) United States Patent
Zemba

(10) Patent No.: US 7,018,220 B2
(45) Date of Patent: Mar. 28, 2006

(54) MULTIPLE POLE CONNECTOR

(75) Inventor: Hirotaka Zemba, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/996,360

(22) Filed: Nov. 26, 2004

(65) Prior Publication Data

US 2005/0118871 A1 Jun. 2, 2005

(30) Foreign Application Priority Data

Nov. 28, 2003 (JP) ..... 2003-398705

(51) Int. Cl.
*H01R 13/648* (2006.01)

(52) U.S. Cl. ..... 439/98; 439/610

(58) Field of Classification Search ..... 439/607–610, 439/92, 449, 492, 497, 98–99, 460, 578, 439/585

See application file for complete search history.

(56) References Cited

U.S. PATENT DOCUMENTS

| | | | | |
|---|---|---|---|---|
| 3,622,952 | A * | 11/1971 | Hilbert | 439/610 |
| 4,243,290 | A * | 1/1981 | Williams | 439/610 |
| 4,377,320 | A * | 3/1983 | Lathrop et al. | 439/585 |
| 4,493,525 | A * | 1/1985 | Hall et al. | 439/610 |
| 4,579,415 | A | 4/1986 | Van Brunt et al. | |
| 4,760,765 | A | 8/1988 | Nishimoto et al. | |
| 5,938,475 | A * | 8/1999 | Penner et al. | 439/610 |
| 6,702,611 | B1 * | 3/2004 | Miyazaki et al. | 439/559 |
| 2002/0002005 | A1 | 1/2002 | Whybrow | |

FOREIGN PATENT DOCUMENTS

| | | |
|---|---|---|
| DE | 4307728 A1 | 3/1991 |
| DE | 19841572 C1 | 9/1998 |
| JP | 11-354218 | 12/1999 |

* cited by examiner

*Primary Examiner*—Paula A. Bradley
*Assistant Examiner*—Edwin A. Leon
(74) *Attorney, Agent, or Firm*—Takeuchi&Kubotera, LLP

(57) ABSTRACT

A ground hardware (26) is crimped to the shield layer (34) of a shield cable (30). A contact spring (6) is put in the a cord tube (5). By connecting the cord tube (5) to the plug shell (2), the contact spring (6) is brought into contact with the ground hardware (36) to electrically connect the shield layer (34) to the plug shell (2).

5 Claims, 11 Drawing Sheets

FIG. 4 (1)
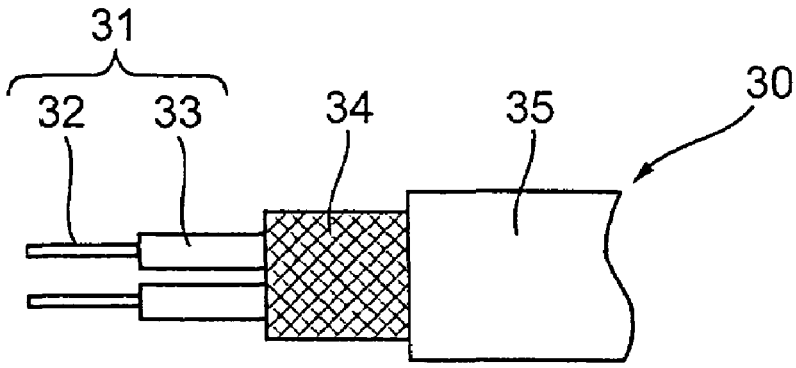
FIG. 4 (2)
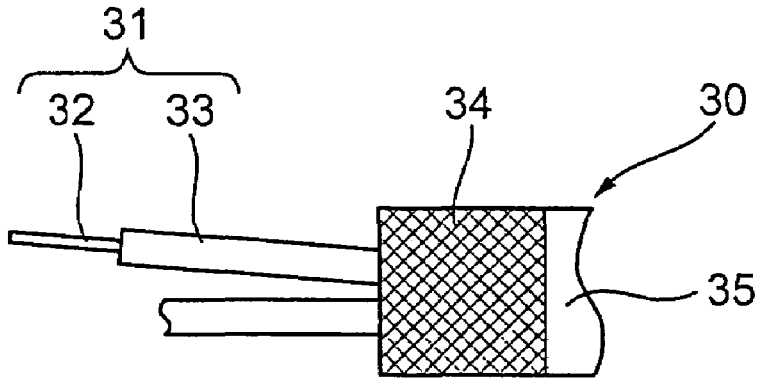
FIG. 4 (3)
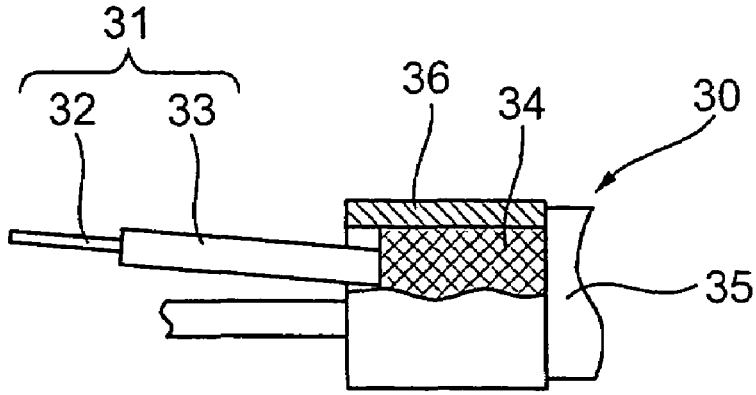

FIG. 15 (1)
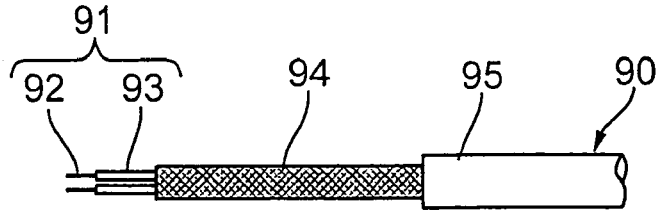
FIG. 15 (2)
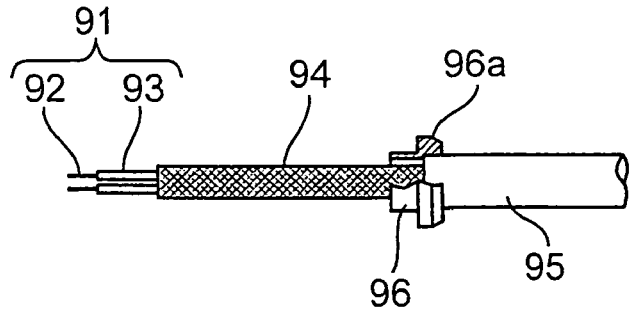
PRIOR ART
FIG. 16 (1)
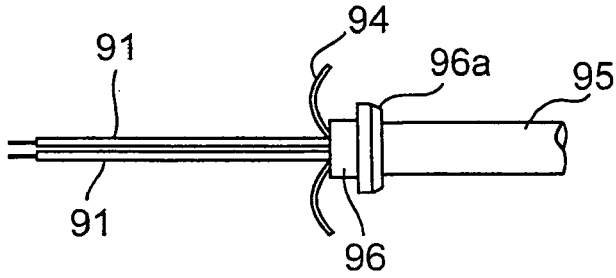
FIG. 16 (2)
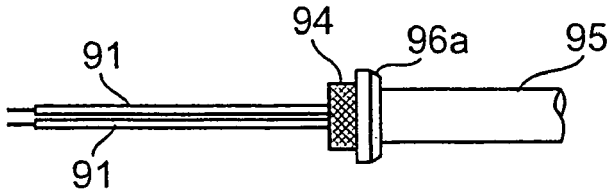
FIG. 16 (3)
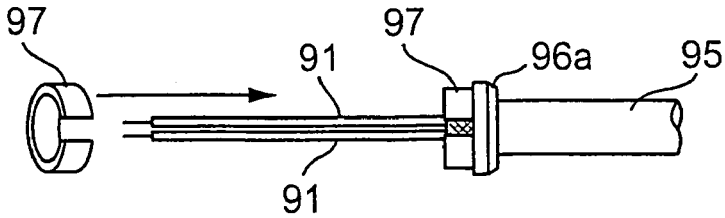
PRIOR ART

MULTIPLE POLE CONNECTOR

BACKGROUND OF THE INVENTION

1. Field of the Invention

The present invention relates to electrical connectors and, particularly, to a multiple pole connector.

2. Background Art

FIG. 14 shows the connector plug 70 of a conventional multiple pole connector. The connector plug 70 includes a metal plug shell 71, a sleeve 73 rotatably attached to the plug shell 71 to form a mating connector plugging recess 72, an insulative case 74 fitted in the plug shell 71 and made of a synthetic resin, a plurality of female terminals 78 supported by the insulative case 74, a cord tube 79 connected to the plug shell 71, and a cord clamp 85. The plug shell 71 has a cord tube connection section 80 with a male thread 81. The insulative case 74 has a plurality of terminal apertures 82 in the axial direction.

As shown in FIG. 15(1), the shield cable 90 includes a plurality of conductors 91 each made of a plurality of twisted wires 92 covered with an inner insulative layer 93. These conductors 91 are covered with a shield layer 94, which is covered with an outer sheath 95.

In the order of FIGS. 15(1) and (2) and FIGS. 16(1), (2), and (3), an end of the shield cable 90 is provided with a cap 96 and a ring member 97. More specifically, the front portions of the wires 92, the inner insulative layer 93, and the shield layer 94 are exposed. As shown in FIG. 15(2), the cap 96 with a male thread 96*a* is put on the end of the outer sheath 95. As shown in FIGS. 16(1) and (2), the shield layer 96 is folded back to cover the edge of the cap 96. As shown in FIG. 16(3), a conductive ring 97 with an C-shaped section is fitted over the folded portion of the shield layer 94 to press the shield layer 94 against the cap 96.

As shown in FIG. 17, a metal sleeve 83 is put on the end of the shield cable 90, with the female terminal 78 in contact with the exposed conductor 91. The sleeve 83 is secured to the cap 96 by engaging the female thread 83*a* of the sleeve 83 with the male thread 96*a* of the cap 96, while the female terminal 78 is fitted in the terminal aperture 82 of the insulative case 74.

As shown in FIG. 14, the cord tube 79 is secured to the plug shell 71 by engaging the female thread 79*a* with the male thread 81. A gasket 84 is put in the gasket mounting section of the cord tube 79, and the cord clamp 85 is put on the cord tube 79 to press the gasket 84 against the shield cable 90, thereby providing the waterproof effect and gripping the shield cable 90. In the connector plug 70, the shield layer 94 of the shield cable 90 is electrically connected to the plug shell 71 via the sleeve 83.

In JP 11-354218, the shield layer is electrically connected to the shield shell by putting an inner ring over the exposed shield layer and an outer ring over the shield cable to hold the shield layer between them, bringing the shield layer into contact with the outer ring and inserting the end of the shield cable into the housing such that the a spring contact piece comes into spring contact with the shield shell in the housing.

The former of the above conventional multiple pole connectors uses the cap 96, the ring 97, and sleeve 83 to connect the shield layer 94 to the plug shell 71, especially putting the sleeve 83 on the end of the shield cable 90 and engaging the female thread 83*a* of the sleeve 83 with the male thread 96*a* of the cap 96. This method, however, requires many steps and complex assembling operations.

The latter of the above conventional multiple pole connectors holds the exposed shield layer between the inner and outer rings, bringing the shield layer into contact with the outer ring and inserting the end of the shield cable into the housing, thereby the spring contact piece into spring contact with the shield shell. This method also requires many assembling steps and complex assembling operations.

SUMMARY OF THE INVENTION

Accordingly, it is an object of the invention to provide a multiple pole connector enabling to reduce the number of assembling steps and simplify the assembling operation.

According to the invention there is provided a multiple pole connector which includes a shield conductive member; an insulative support member provided in said shield conductive member; at least one terminal supported by said insulative support member and connected to a conductor of a shield cable; a shield cable holding member connected to said shield conductive member; a contact spring provided between said shield cable holding member and a shield layer of said shield cable for electrical connection between said shield conductive member and said shield layer.

By connecting the shield cable holding member to the shield conductive member, the contact spring is electrically connected to the shield layer of a shield cable so that the shield layer is electrically connected to the shield conductive member. Consequently, it is unnecessary to use a sleeve for covering the end of a shield cable and screw a cap over the sleeve, thus not only minimizing the number of assembling steps but also simplifying the assembling operation.

The shield conductive member may be a metallic plug shell, the insulative support member may be an insulative case made of a synthetic resin, and the shield cable holding member may be a cord tube.

The multiple pole connector may further comprise a ground member provided on said shield layer so as to come into contact with said contact spring for electrical connection between said shield layer and said shield conductive member. By connecting the shield cable holding member to the shield conductive member, the contact spring is brought into contact with the ground member to electrically connect the shield layer to the shield conductive member. Consequently, it is unnecessary to use a sleeve for covering the end of a shield cable and screw a cap over the sleeve, thus not only minimizing the number of assembling steps but also simplifying the assembling operation. The ground member may be a metallic ground hardware.

The shield cable holding member may have a spring receiving recess for receiving said contact spring such that peripheral and central contacts of said contact spring come into contact with said spring receiving recess and said ground member, respectively. The contact spring is put in the spring receiving recess and compressed in the radial direction in advance so that by connecting the shield cable holding member to the shield conductive member, the contact spring is brought into contact with the ground member to electrically connect the shield layer to the shield conductive member. Consequently, not only the number of assembling steps is minimized but also the assembling operation is simplified. The shield cable holding member may be a cord tube.

The contact spring has a C-shaped section with opposed end edges and a plurality of openings, with a concave central portion, thereby providing V-shaped central contacts and peripheral contacts on opposite side edges. The openings facilitate the radial compression and expansion of the contact spring. When the contact spring is put in the spring receiving recess and compressed in the radial direction, the central and peripheral contacts come to firm contact with the ground member and the spring receiving recess, respectively.

The ground member may be crimped to said shield layer that has been folded back on the outer sheath of said shield cable. The ground member is crimped to the folded-back shield layer so that by bringing the ground member into contact with the contact spring, the shield layer is electrically connected to the shield conductive member.

According to the invention, by connecting the shield cable holding member to the shield conductive member the contact spring is brought into contact with the shield layer to electrically connect the shield layer to the shield conductive member so that it is unnecessary to use a sleeve for covering the end of a shield cable and screw a cap over the sleeve, thus minimizing the number of assembling steps and simplifying the assembling operation.

By connecting the shield cable holding member to the shield conductive member the contact spring is brought into contact with the ground member to electrically connect the shield layer to the shield conductive member so that it is unnecessary to use a sleeve for covering the end of a shield cable and screw a cap over the sleeve, thus minimizing the number of assembling steps and simplifying the assembling operation.

The contact spring is put in the spring receiving recess with compressed in the radial direction in advance so that by connecting the shield cable holding member to the shield conductive member the contact spring is brought into contact with the ground member to electrically connect the shield layer to the shield conductive member so that not only the number of assembling steps is minimized but also the assembling operation is simplified.

The contact spring has a C-shaped section and a concave central portion with openings and is flexible in the radial direction so that when it is put in the spring receiving recess with compressed in the radial direction the central and peripheral contacts make firm contacts with the ground member and the spring receiving recess, respectively.

The ground member is crimped to the folded-back shield layer so that by bringing the contact spring into contact with the ground member it is possible to electrically connect the shield layer to the shield conductive member.

BRIEF DESCRIPTION OF THE DRAWINGS

FIGS. 4(1), (2), and (3) are side views of an end portion of a shield cable;

FIGS. 15(1) and (2) and 16(1), (2), and (3) are side views of an end portion of a shield cable.

DESCRIPTION OF THE PREFERRED EMBODIMENTS

Embodiments of the invention will now be described with reference to FIGS. 1–13.

Figure 1:
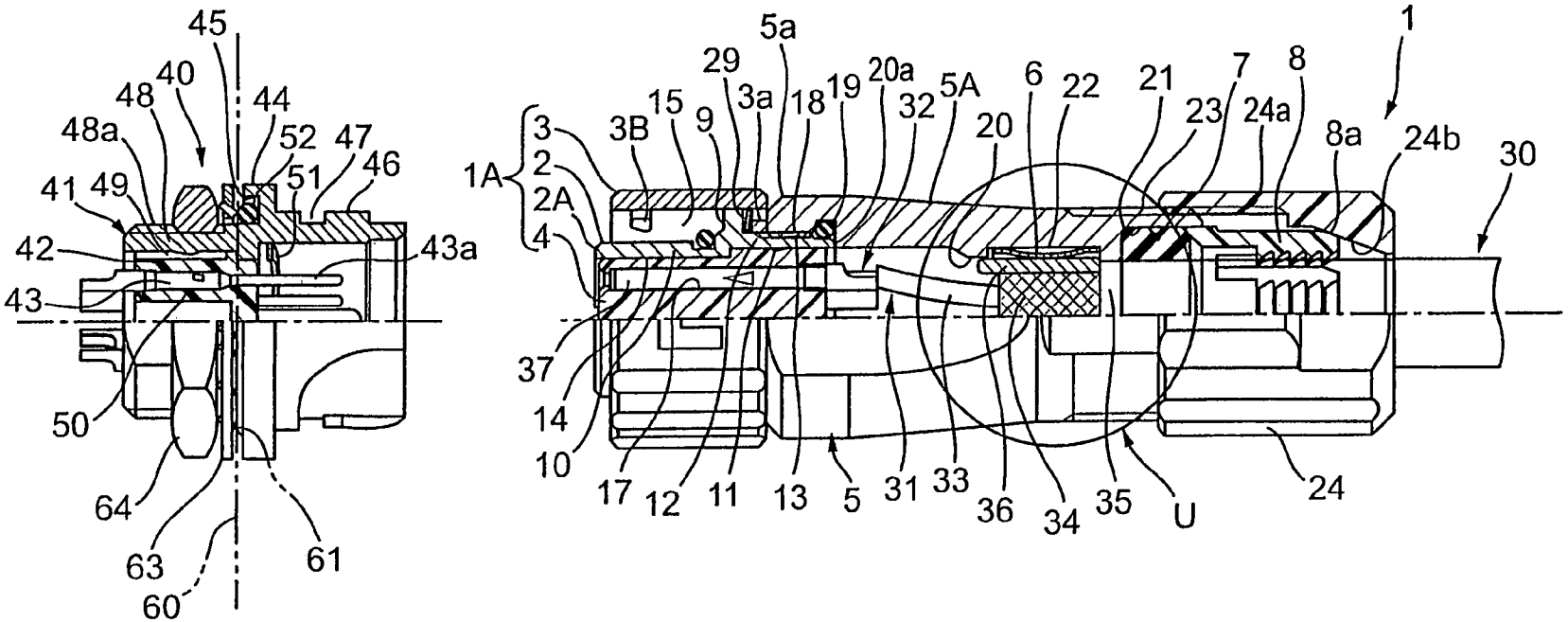
FIG. 1 is a side view, partially in section, of a multiple pole connector according to an embodiment of the invention.

As shown in FIG. 1, the multiple pole connector system includes a connector plug 1 and a connector receptacle (hereinafter "receptacle") 40. The connector plug 1 has a connector body 1A which includes a shielding conductive member or metal plug shell 2, a sleeve 3 rotatably attached to the plug shell 2 to form a mating connector plugging recess 15, and an insulative holding member or case 4 fitted in the plug shell 2 and made of a synthetic resin.

Figure 5:
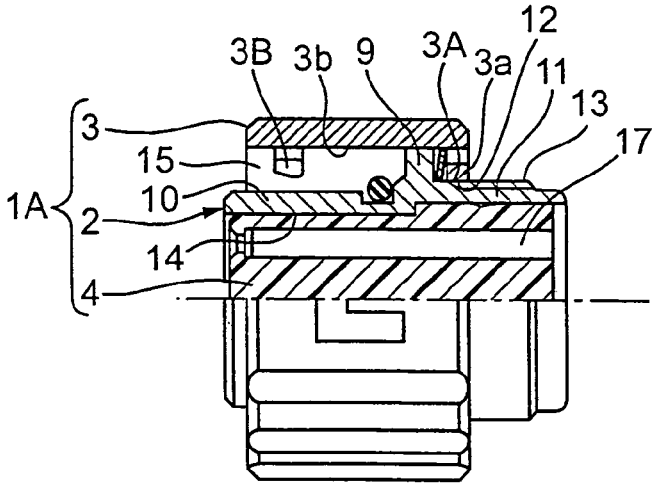
FIG. 5 is a side view, partially in section, of a connector plug of the multiple pole connector.

As shown in FIG. 5, the plug shell 2 has a partition section or flange 9 in a central portion to provide a front plugging face 10 and a rear cord tube connection section 11 which has a sleeve support 12 and a male thread 13. An insulative case fitting section 14 is provided on the inside of the plug shell 2. The sleeve 3 has a pivot aperture 3A in the rear wall 3*a* and an engaging projection 3B on the inside face 3*b*.

The sleeve 3 is rotatably attached to the plug shell 2 by engaging the pivot aperture 3A with the sleeve support 12 such that the partition section 9 slides on the inside face 3*b* of the sleeve 3. The mating connector plugging recess 15 is defined by the sleeve inside face 3*b*, the plugging face 10, and the partition section 9. The insulative case 4 is fitted in the insulative case fitting section 14 of the plug shell 2. It has a plurality of terminal insertion apertures 17 in the axial direction.

Figure 7:
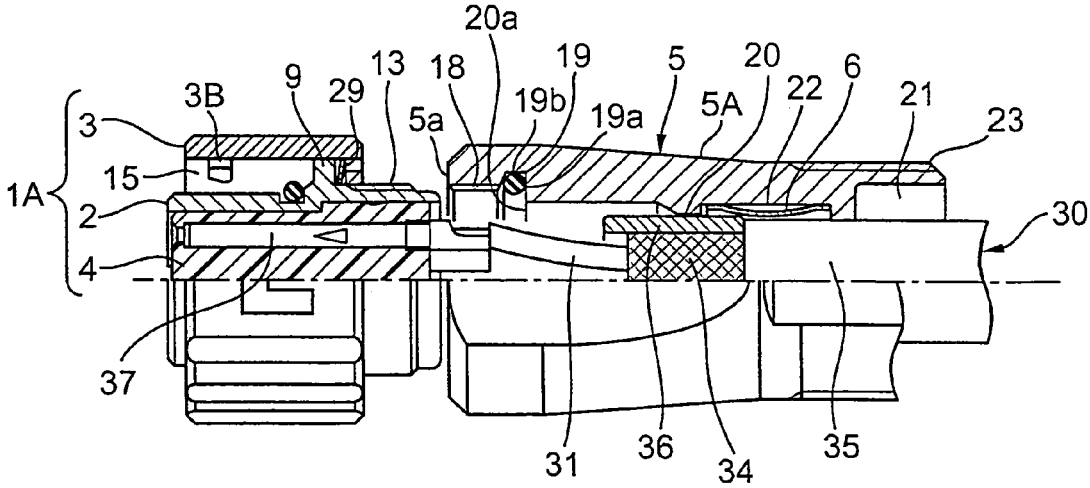
FIG. 7 is a side view of the connector body wherein the connection of a cord tube is initiated.

As shown in FIG. 7, the shield cable holding member or cord tube 5 has a cylindrical body 5A which has a female thread 18, an O-ring groove 19, an inner aperture 20, and a gasket mounting section 21. A spring receiving recess 22 is provided in the inside face of the inner aperture 20. A male thread 23 is provided on the end of the tube body 5A. An abutment face 20*a* communicates with the rear wall 19*a* of the O-ring receiving groove 19 in which an O-ring 19*b* is provided.

Figure 9:
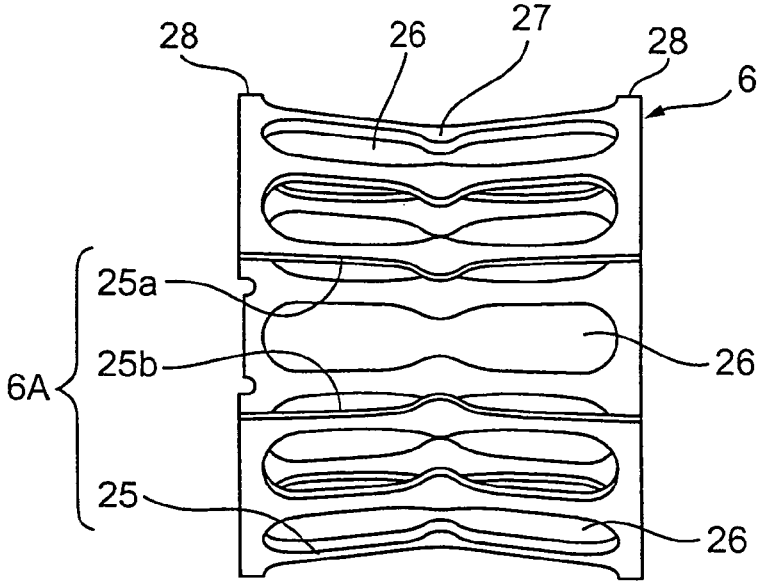
FIG. 9 is a side view of a contact spring for the connector plug.
Figure 10:
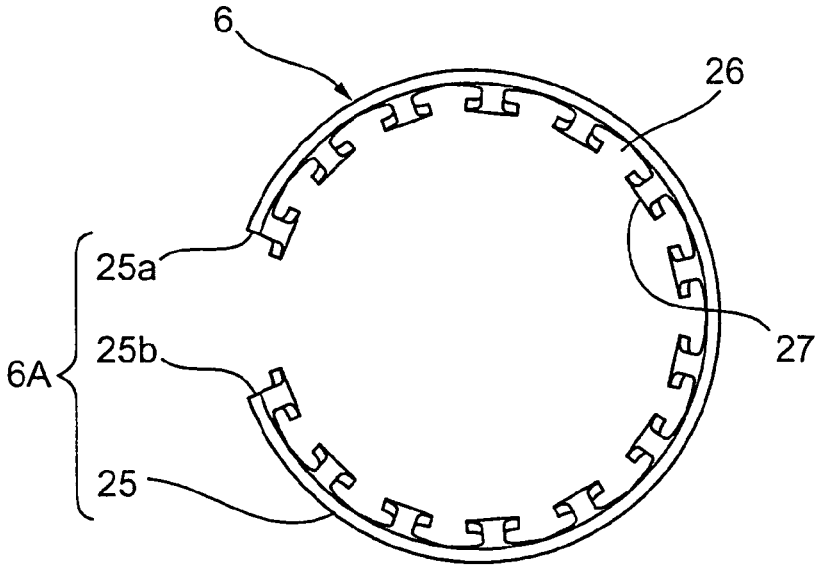
FIG. 10 is a front view of the contact spring.

As shown in FIGS. 9 and 10, the contact spring 6 has a spring body 6A which is made by bending a comb-shaped metal plate 25 into a C-shaped cylindrical member with opposed edges 25*a* and 25*b*. A plurality of openings or slots 26 are provided in the spring body 6A at regular intervals. The central portion of the spring body 6A is reduced so as to provide a concave shape with V-shaped ground central contacts 27 and cord tube peripheral contacts 28 at opposite side edges.

The contact spring 6 is put in the spring receiving recess 22 such that it is compressed in the radial direction, with the cord tube peripheral contacts 28 in contact with the bottom face 22*a* of the spring receiving recess 22 and the ground central contacts 27 projecting inwardly. The cord tube 5 is movably attached to the shield cable 30 by inserting the shield cable 30 into the inner aperture 20. Also, the gasket 7, the cord clamp 8, and the tightening ring 24 are movably attached to the shield cable 30.

As shown in FIG. 4(1), the shield cable 30 includes a plurality of conductors 31 each consisting of a plurality of twisted wires 32 covered by an inner insulative layer 33, a shield layer 34 for covering the conductors 31, and an outer sheath 35 for covering the shield layer 34. The shield layer 34 is made by weaving fine metal wires. Front portions of the conductors 32, the inner insulative layer 33, and the shield layer 34 of the shield cable 30 are exposed. As shown in FIG. 4(2), the shield layer 34 is folded back on the outer sheath 35. As shown in FIG. 4(3), the ground metal hardware 36 is crimped to the folded-back shield layer 34 so that it is electrically connected to the shield layer 34.

Figure 6:
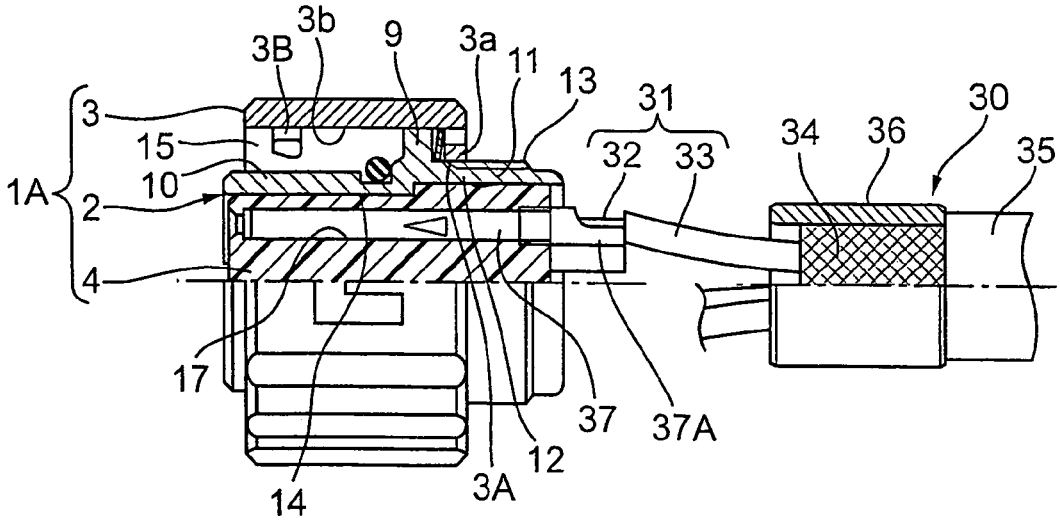
FIG. 6 is a side view wherein the shield cable is connected to a connector body of the connector plug.

As shown in FIG. 6, the female terminal 37 is connected to the exposed portion of the conductor 32 by crimping the barrel portion 37A. It is inserted into the terminal aperture 17 of the insulative case 4 for fixing.

Figure 8:
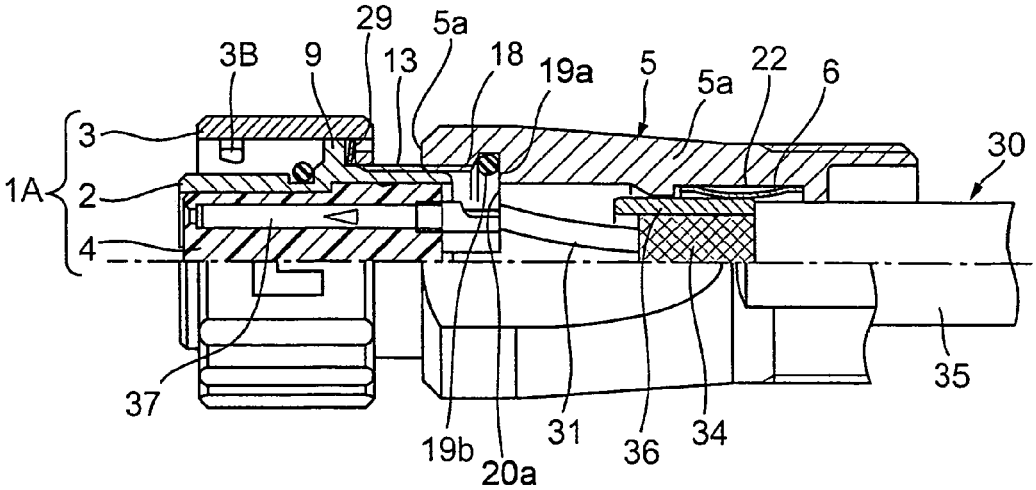
FIG. 8 is a side view of the connector body to which the cord tube is being connected.

As shown in FIGS. 7 and 8, the cord tube 5 is moved toward the plug shell 2 to screw the female thread 18 of the cord tube 5 to the male thread 13 of the plug shell 2, abutting the front face 5*a* of the cord tube 5 against the rear wall 3*a* of the sleeve 3 (FIG. 1) so that the rear wall 3*a* press the plug shell 2 against the partition rim 9 via the spring washer 29, thus securing the cord tube 5 to the plug shell 2. At this point, the abutment face 20*a* of the cord tube 5 is abutment with the rear end of the plug shell 2.

Figure 2:
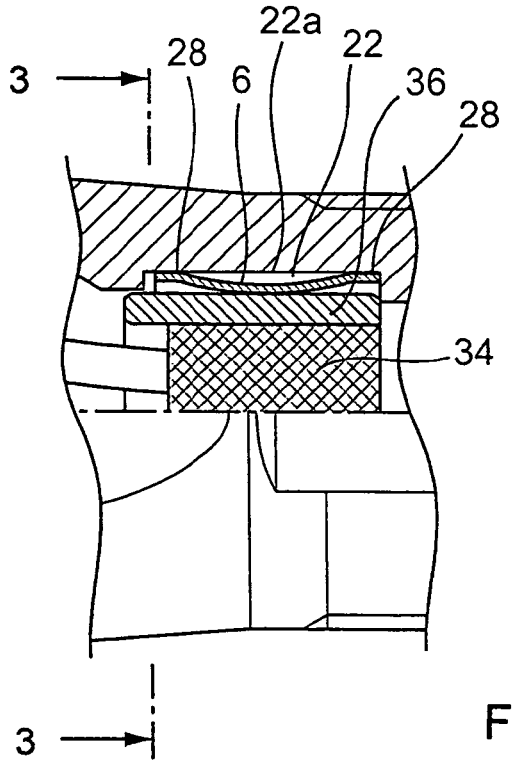
FIG. 2 is an enlarged view of the area U of FIG. 1.
Figure 3:
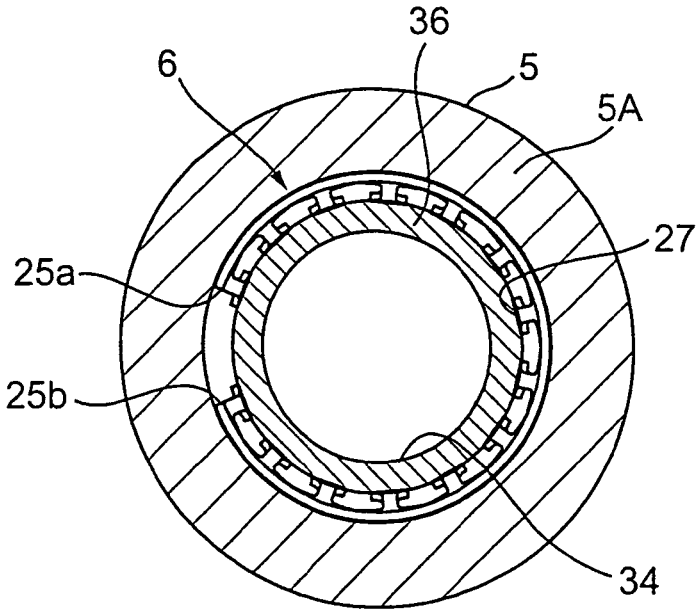
FIG. 3 is a sectional view taken along line 3—3 of FIG. 2.

As shown in FIGS. 1–3, when the abutment face 20*a* of the cord tube 5 is in abutment with the rear end of the plug shell 2, the ground contacts 27 of the contact spring 6 is in contact with the ground metal hardware 36 of the shield cable 30.

As shown in FIG. 1, the cord clamp 8 is moved toward the gasket 7 to press the gasket 7 with its front end by inserting the gasket 7 in the gasket receiving section 21 of the cord tube 5 and engaging the female thread 24*a* of the tightening ring 24 with the male thread 23 of the cord tube 5 to press the tapered section 23*b* of the tightening ring 24 against the tapered section 8*a* of the cord clamp 8. The gasket 7 is deformed in the radial direction to press the shield cable 30 for producing the waterproof effect while the cord clamp 8 is deformed in the radial direction to grip the shield cable 30.

In the connector plug 1, the shield layer 34 of the shield cable 30 is electrically connected to the plug shell 2 via the metallic ground hardware 36, the contact spring 6, and the cord tube 5. The electrical connection between the shield layer 34 and the ground hardware 36 is made by crimping the ground hardware 36 to the folded-back portion of the shield layer 34. The electrical connection between the ground hardware 36 and the contact spring 6 is made by abutting the ground contacts 27 of the contact spring 6 against the ground hardware 36. The electrical connection between the contact spring 6 and the cord tube 5 is made by abutting the peripheral contacts 28 of the contact spring 6 against the bottom face 22*a* of the spring receiving recess 22. The contact between the cord tube 5 and the plug shell 2 is made by abutting the abutment face 20*a* of the cord tube 5 against the rear end of the plug shell 2.

Figure 11:
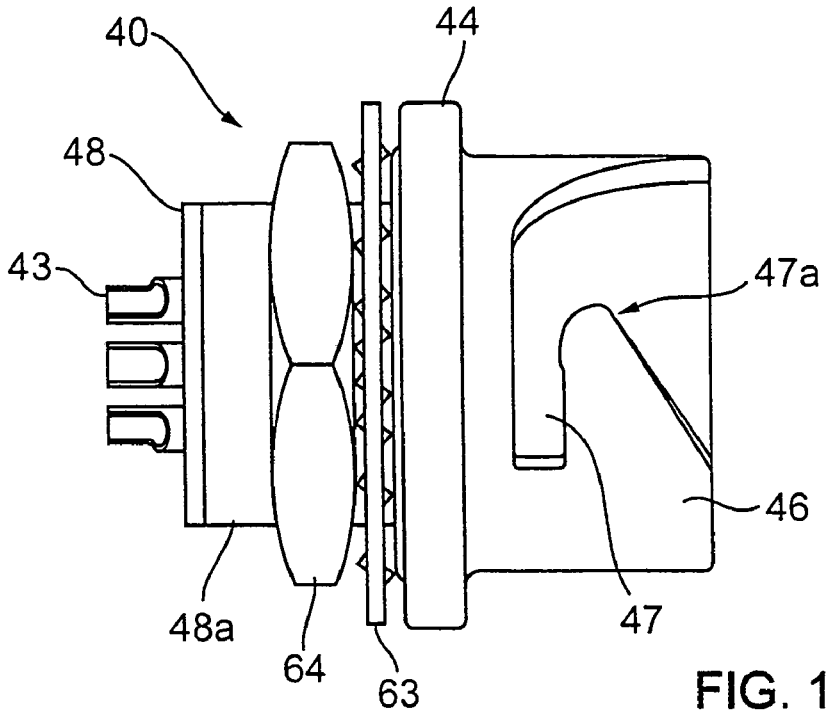
FIG. 11 is a side view of a connector receptacle for the multiple pole connector.
Figure 12:
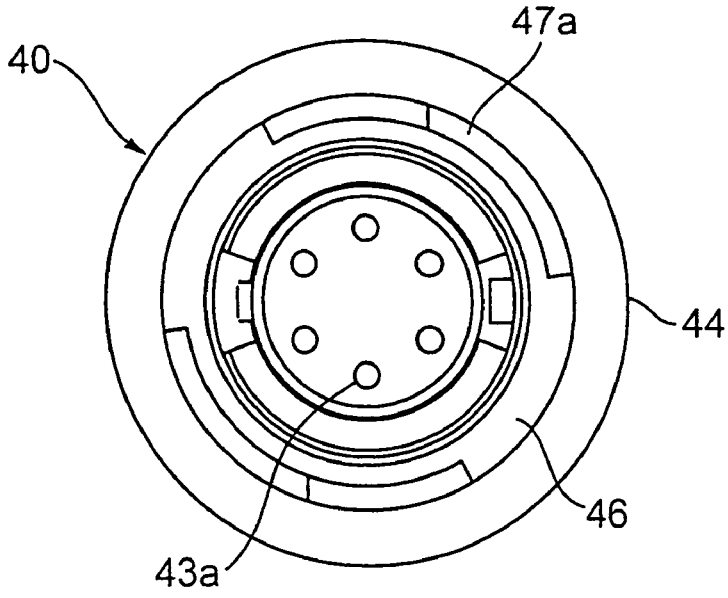
FIG. 12 is a front view of the connector receptacle.

As shown in FIGS. 1, 11, and 12, the receptacle 40 includes a metal receptacle shell 41, an insulative case 42 fitted in the receptacle shell 41 and made of a synthetic resin, and a plurality of male terminals 43 supported by the insulative case 42. The receptacle shell 41 has a flange section 44 in the central portion to provide a front cylindrical plugging section 46. As shown in FIGS. 11 and 12, a guide groove 47*a* and an engaging groove 47 are provided in the side wall of the plugging section 46.

A rear cylindrical section 48 has a male thread 48*a*. An insulative case fitting section 49 is provided on the inside of the receptacle shell 41. The insulative case 42 is fitted in the fitting section 49 and has a plurality of terminal insertion apertures 50 in the axial direction. The male terminal 43 is inserted into the terminal insertion apertures 50 such that the contact section 43*a* projects into the plugging section 46. A contact ring 51 is put in the plugging section 46 and has a corrugated back side for contact with the receptacle shell 41.

How to connect the connector plug 1 and the receptacle 40 will be described below.

As shown in FIG. 1, an O-ring 52 is put in the O-ring groove 45 of the flange section 44 and the threaded section 48 of the receptacle shell 41 is put through the hole 61 of a conductive wall 60 of an electrical device (not shown). Then, a washer 63 is put on the threaded section 48, and a nut 64 is tightened to hold the conductive wall 60 between the flange section 44 and the washer 63, thereby securing the receptacle 40 to the electrical device.

Figure 13:
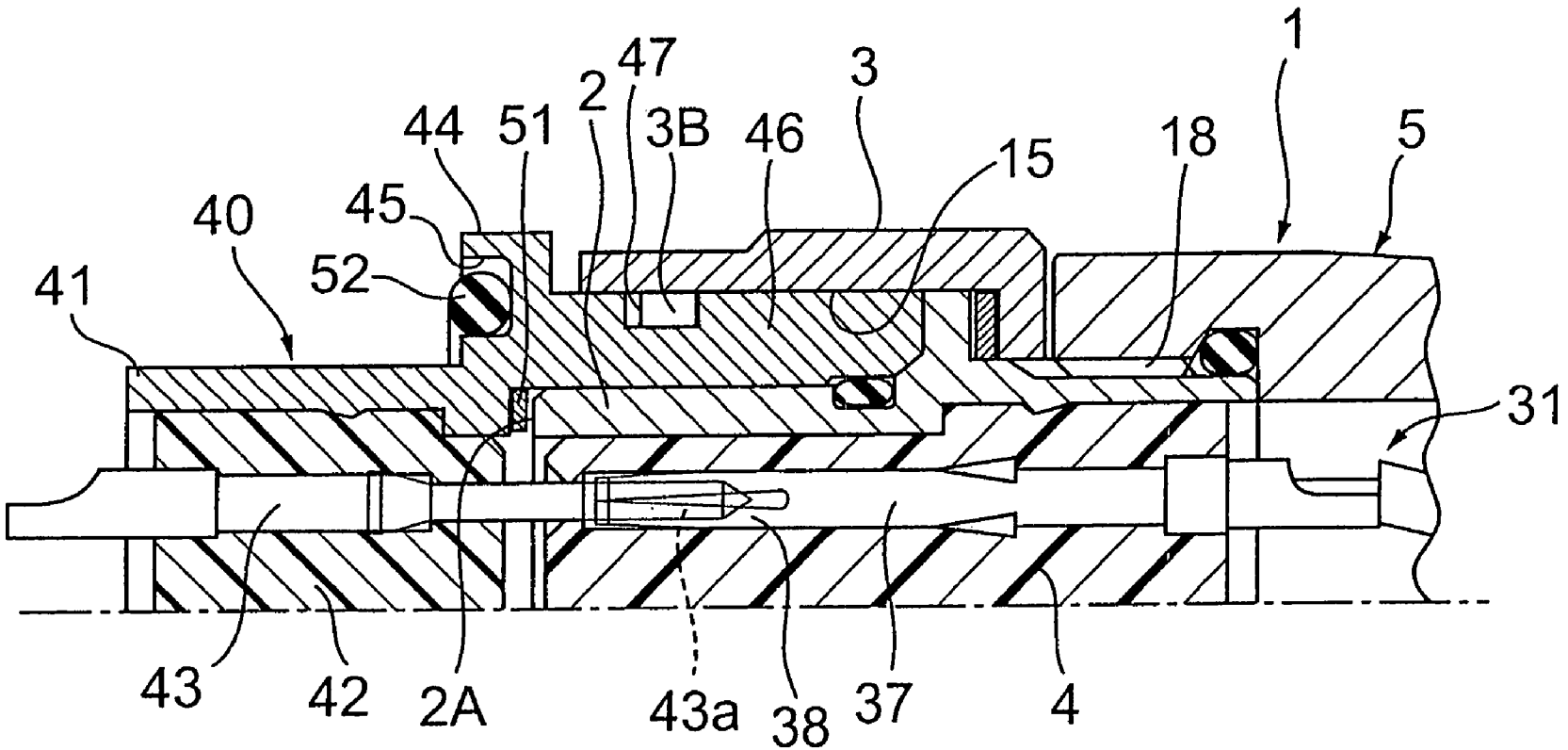
FIG. 13 is a sectional view of the connector plug and receptacle plugged to each other.
Figure 14:
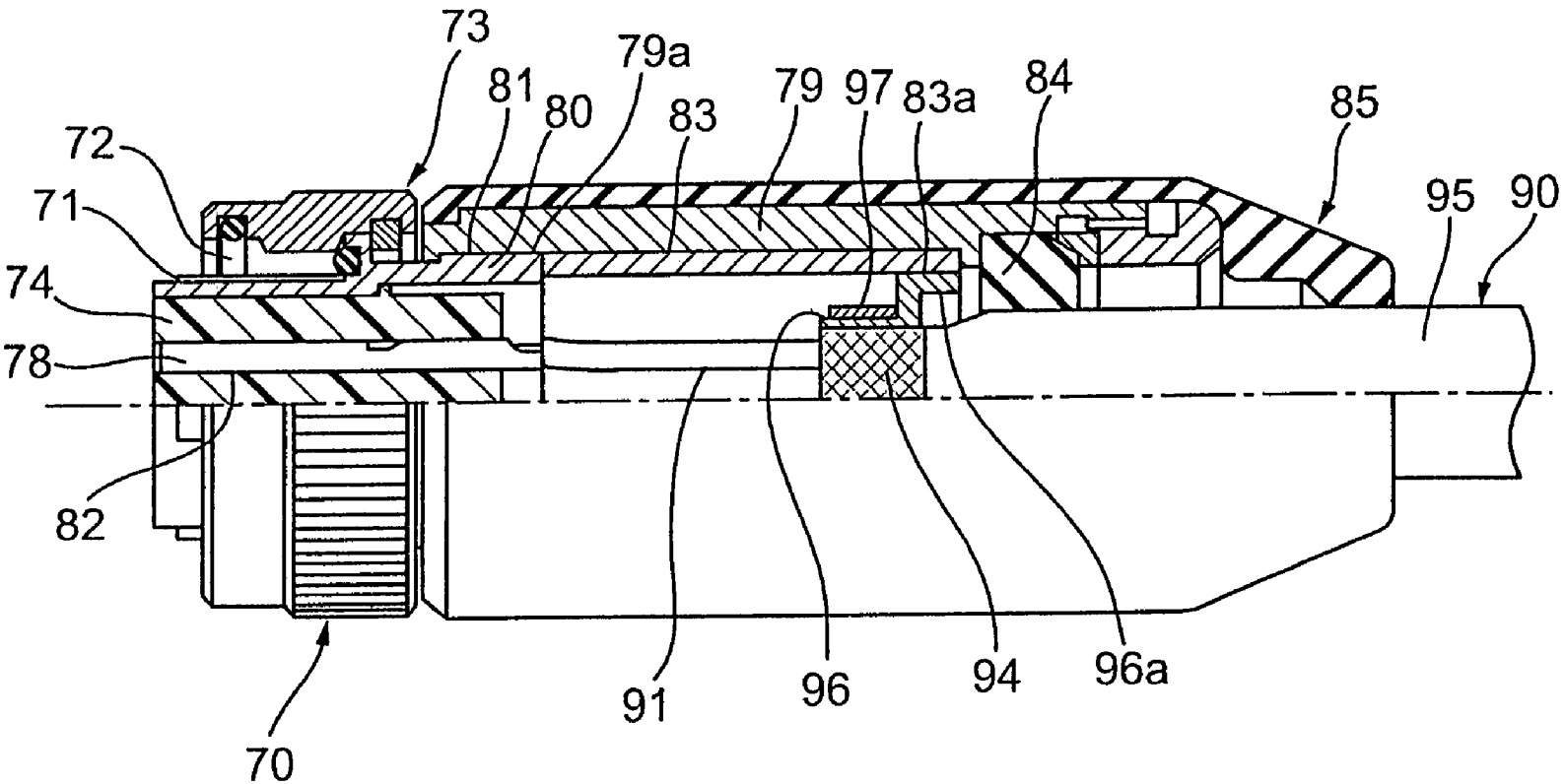
FIG. 14 PRIOR ART
FIG. 14 is a side view, partially in section, of a conventional connector plug.
Figure 17:
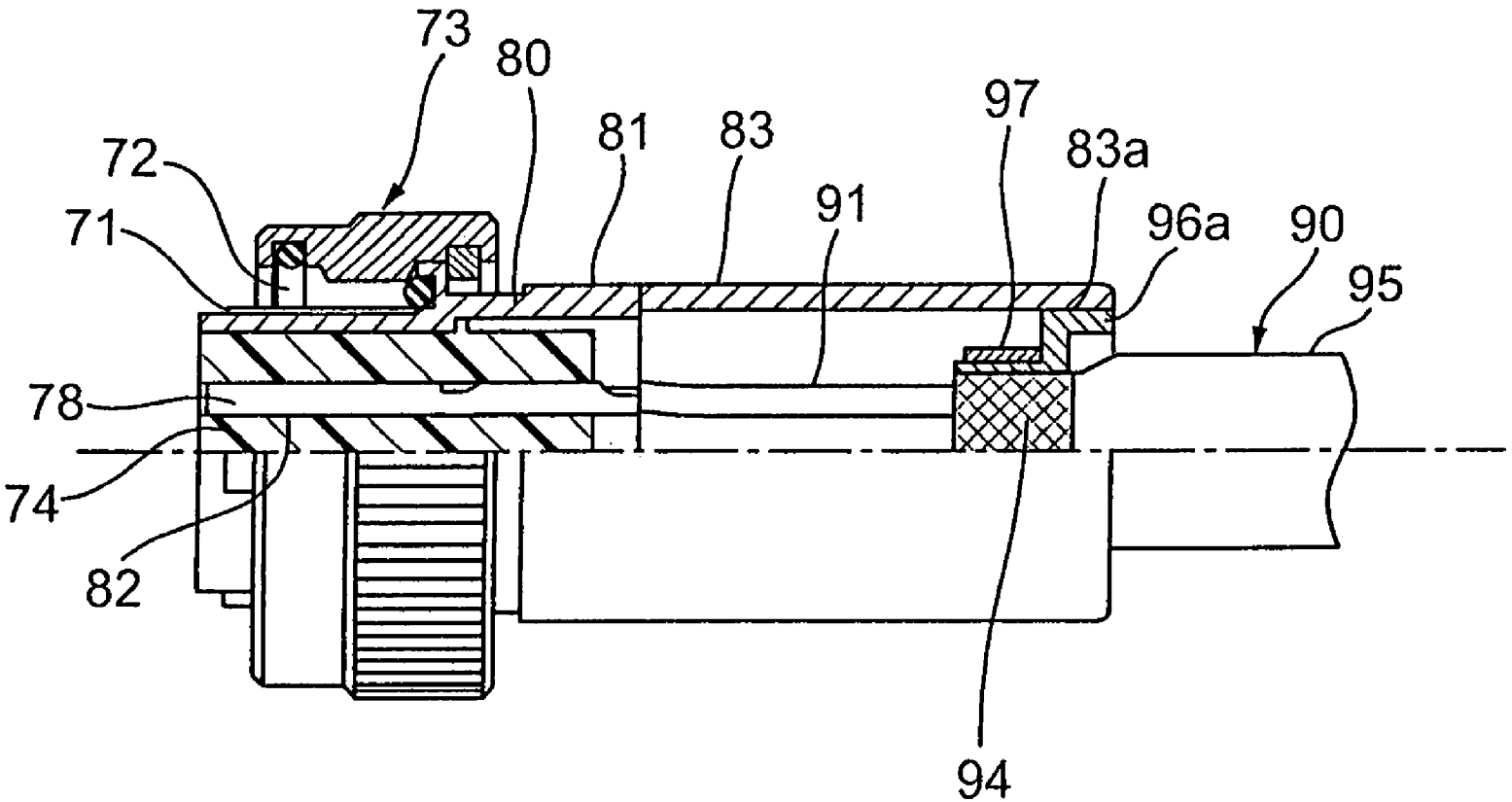
FIG. 17 PRIOR ART
FIG. 17 is a side view of the connector plug for a conventional multiple pole connector.

As shown in FIG. 13, the plugging section 46 of the receptacle shell 41 is fitted into the plugging recess 15 of a mating connector plug 1 to connect the connecting section 38 of the female terminal 37 to the contact section 43*a* of the male terminal 43, bringing the front end 2A of the plug shell 2 into contact with the receptacle shell 41 via the contact member 51 to connect the connector plug 1 to the receptacle 40.

That is, to fit the plugging section 46 of the receptacle shell 41 into the plugging recess 15 of a mating connector plug 1, the engaging projection 3B of the sleeve 3 is fitted in the guide groove 37*a* of the plugging section 46, and the connector plug 1 is pushed in while the sleeve 3 is turned to engage the engaging projection 3B with the engaging groove 47. When the plugging section 46 is completely fitted in the plugging recess 15, the front end 2A of the plug shell 2 comes into contact with the receptacle shell 41 via the contact member 51.

Thus, the shield layer 34 of the shield cable 30 is electrically connected to the case wall 60 of the electrical device via the ground hardware 36, the contact spring 6, the cord tube 5, the plug shell 2, the contact member 51, and the receptacle shell 41.

As has been described above, according to the invention, the shield cable 30 is provided with the ground hardware 36 to come into contact with the shield layer 34. The contact spring 6 is put on the cord tube 5 and is brought into contact with the ground hardware 36 to electrically connect the shield layer 34 to the plug shell 2, thereby bringing the contact spring 6 into contact with the ground hardware 36 to electrically connect the shield layer 34 to the plug shell 2. Consequently, it is unnecessary to use a sleeve which covers the end of a shield cable and screw a cap to the end of the sleeve, minimizing the number of assembling steps and simplifying the assembling operation.

The contact spring 6 is put in the spring receiving recess 22 such that it is compressed in the radial direction, and the peripheral contacts 28 are in contact with the bottom face 22*a* of the spring receiving recess 22, and the central ground contacts 27 project inwardly. The contact spring 6 is assembled in the cord tube 5 in advance so that the cord tube 5 is connected to the plug shell 2 to bring the contact spring 6 into contact with the ground hardware 36, electrically connecting the shield layer 34 to the plug shell 2, thus not only reducing the number of assembling steps but also simplifying the assembling operation.

The contact spring 6 has a C-shaped section and has a concave central portion and a plurality of openings to facilitate the radial compression and expansion. When the contact spring 6 is put in the receiving recess 22 with compressed in the radial direction, the peripheral contacts 28 come into secure contact with the bottom face 22*a* of the receiving recess 22 and the central ground contacts 27 come into secure spring contact with the ground hardware 36.

The ground hardware 36 is crimped to the folded-back portion of the shield layer 34 so that the contact between the ground hardware 36 and the contact spring 6 electrically connects the shield layer 34 and the plug shell 2. The contact spring 6 may be provided with a spring property by making continuous one end and cutting the other end of the edges 25*a* and 25*b* of the spring plate 25. A plurality of projections may be provided so as to extend toward the axis of the cylindrical contact spring 6 and the peripheral edge of the contact spring 6 may be used as the peripheral contacts 28. In essence, the ground contacts may be made so as to project toward the axis of the inner aperture 20 and be spaced from the bottom of the spring receiving recess.

The shield cable holding member is connected to the shield conductive member, bringing the contact spring into contact with the ground hardware to electrically connect the shield layer to the shield conductive member. Consequently, it is unnecessary to use a sleeve which cover the end of a shield cable and a cap screwed to the sleeve end, thereby minimizing the assembling steps and simplifying the assembling operation and useful for a multiple pole electrical connector.

The invention claimed is:

1. A multiple pole connector comprising:

a shield conductive member;

an insulative support member provided in said shield conductive member;

at least one terminal supported by said insulative support member and connected to a conductor of a shield cable;

a shield cable holding member connected to said shield conductive member;

a contact spring provided in the shield cable holding member for electrical connection between said shield conductive member and a shield layer of the shield cable, said contact spring including a front edge portion and a rear edge portion in a longitudinal direction of the shield cable holding member;

a ground member provided between the shield layer and the contact spring for electrical connection between the shield layer and the shield conductive member, said ground member being crimped to the shield layer folded back on an outer sheath of the shield cable; and a spring receiving recess formed in the shield cable holding member for receiving the contact spring, said spring receiving recess including a front end portion and a rear end portion in the longitudinal direction of the shield cable holding member such that the front edge portion engages with the front end portion and the rear edge portion engages with the rear end portion.

2. The multiple pole connector according to claim 1, wherein said spring receiving recess is arranged such that peripheral and central contacts of said contact spring come into contact with said spring receiving recess and said ground member, respectively.

3. The multiple pole connector according to claim 2, wherein said ground member is crimped to said shield layer folded back on an outer sheath of said shield cable.

4. The multiple pole connector according to claim 1, wherein said contact spring has a C-shaped section, a plurality of openings, and a concave central portion thereby providing v-shaped central contacts and peripheral contacts.

5. The multiple pole connector according to claim 4, wherein said ground member is crimped to said shield layer folded back on an outer sheath of said shield cable.

* * * * *